US009322594B2

(12) United States Patent
Bruckner

(10) Patent No.: US 9,322,594 B2
(45) Date of Patent: Apr. 26, 2016

(54) DRIER

(75) Inventor: Dietmar Bruckner, Gaeufelden (DE)

(73) Assignee: EISENMANN AG, Boeblingen (DE)

( * ) Notice: Subject to any disclaimer, the term of this patent is extended or adjusted under 35 U.S.C. 154(b) by 480 days.

(21) Appl. No.: 13/805,708

(22) PCT Filed: Jun. 9, 2011

(86) PCT No.: PCT/EP2011/002831

§ 371 (c)(1),
(2), (4) Date: Mar. 15, 2013

(87) PCT Pub. No.: WO2011/160778

PCT Pub. Date: Dec. 29, 2011

(65) Prior Publication Data

US 2013/0167395 A1 Jul. 4, 2013

(30) Foreign Application Priority Data

Jun. 23, 2010 (DE) ..... 10 2010 024 840

(51) Int. Cl.

| | |
|---|---|
| ***F26B 21/00*** | (2006.01) |
| ***F26B 13/00*** | (2006.01) |
| ***F26B 21/14*** | (2006.01) |
| ***F26B 15/12*** | (2006.01) |
| ***F26B 25/00*** | (2006.01) |
| *B05D 3/02* | (2006.01) |
| *B05D 7/14* | (2006.01) |

(52) U.S. Cl.

CPC ..... *F26B 21/004* (2013.01); *F26B 13/005* (2013.01); *F26B 15/12* (2013.01); *F26B 21/14* (2013.01); *F26B 25/008* (2013.01); *B05D 3/0272* (2013.01); *B05D 7/14* (2013.01); *F26B 2210/12* (2013.01)

(58) Field of Classification Search

CPC .... F26B 13/005; F26B 21/004; F26B 25/008; F24F 9/00; F24F 2009/002; F24F 2009/005; F24F 2009/007; A47F 3/0447; F24L 15/2028; F25D 23/023; Y10S 55/29

See application file for complete search history.

(56) References Cited

U.S. PATENT DOCUMENTS

| | | | | |
|---|---|---|---|---|
| 4,575,952 | A * | 3/1986 | Bodenan et al. | 34/567 |
| 4,656,758 | A | 4/1987 | Nakayama | |
| 6,065,225 | A | 5/2000 | Herre | |

FOREIGN PATENT DOCUMENTS

| | | | |
|---|---|---|---|
| DE | 1048006 | B | 12/1958 |
| DE | 231413 | A1 | 12/1985 |

(Continued)

*Primary Examiner* — David J Laux

(74) *Attorney, Agent, or Firm* — Factor Intellectual Property Law Group, Ltd.

(57) ABSTRACT

A drier comprising a drier chamber inside a drier housing. An inner atmosphere of the drier chamber has an elevated temperature relative to the outer atmosphere. An inlet lock and an outlet lock reduce the inflow of the outer atmosphere into the drier chamber and the outflow of the inner atmosphere into the outer atmosphere. The inlet lock comprises a first air curtain, which extends over the inlet lock and which runs upward, and a second air curtain, which is behind the first air curtain in the direction of motion of the objects and which extends over the inlet lock and which runs downward. The outlet lock is designed substantially identically to the inlet lock, however the objects first pass through an air curtain directed downward and then pass through an air curtain directed upward. The conveyor system is designed that the objects are moved continuously and at a substantially constant height through the entire drier housing.

7 Claims, 1 Drawing Sheet

(56) References Cited

FOREIGN PATENT DOCUMENTS

| | | | |
|---|---|---|---|
| DE | 19634693 | A1 | 3/1998 |
| DE | 19746415 | C1 | 6/1999 |
| EP | 0890807 | A1 | 1/1999 |
| JP | 1115469 | A | 5/1989 |
| JP | 1299668 | A | 12/1989 |

* cited by examiner

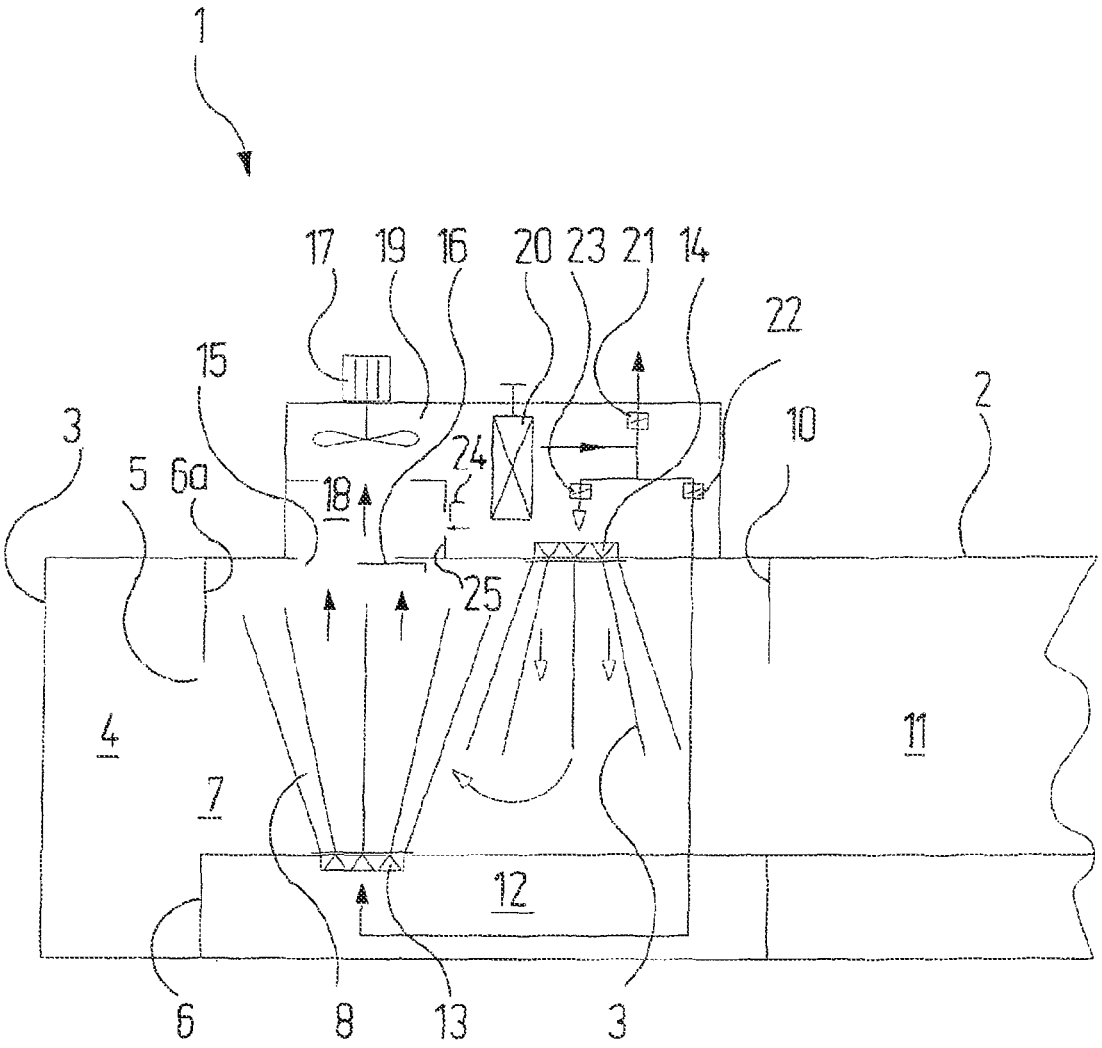
1
17
19
16
20
23
21
14
22
15
3
5
6a
18
24
10
2
25
4
11
7
12
6
8
13
3

DRIER

RELATED APPLICATIONS

This application claims the filing benefit of International Patent Application No. PCT/EP2011/002831, filed Jun. 9, 2011, which claims the filing benefit of German Patent Application No. 10 2010 024 840.1 filed Jun. 23, 2010, the contents of both of which are incorporated herein by reference.

FIELD OF THE INVENTION

The invention relates to a drier for drying objects, in particular painted vehicle bodies or add-on parts, having a) a drier housing;

b) a drier chamber which is arranged in the drier housing and in which an internal atmosphere having a higher temperature than the external atmosphere is present;

c) an inlet lock and an outlet lock which reduce the inflow of the external atmosphere into the drier chamber and the outflow of the internal atmosphere into the external atmosphere;

d) a conveyor system which guides the objects through the inlet lock, the drier chamber and the outlet lock.

BACKGROUND OF THE INVENTION

The term "dry" refers here not only to the removal of liquids, in particular the expulsion of solvents or the crosslinking of wet paint finishes, but also the gelling and so-called "burning-in" of powder coatings.

In all driers, transferring objects into and out of the actual drier chamber through the air locks is associated to a greater or lesser extent with energy losses since it is not possible to completely prevent the inflow of cold air into the drier chamber any more than it is possible to completely prevent the outflow of hot internal atmosphere from the drier chamber into the external atmosphere. In known driers of the type mentioned at the outset, so-called A-locks are used as the inlet and outlet lock. These A-locks are useful in that hot air is lighter than cold air and collects in the upper region of closed chambers. In the case of these A-locks, therefore, the object to be dried is introduced into the lock at a relatively low level and then raised by a lifting device to the level where the hot air is present, which only flows out to a certain extent through the inlet opening located at the lower level. At this higher level, the object to be dried is then introduced substantially horizontally into the drier chamber which is located as a whole at a higher level. The objects to be dried are then moved accordingly downwards in the outlet region to a lower level at which the outlet opening of the outlet lock is also located.

These known driers which operate with A-locks are disadvantageous in that lifting devices are required which involve increased expenditure on apparatus. A further disadvantage is that a continuous passage of the objects to be dried is not possible and is instead interrupted by the two vertical movements in the inlet and outlet lock. This reduces the throughput rate which can be achieved by the driers. Finally, the large spatial requirement in terms of the overall height, which is associated with A-locks, is also a notable disadvantage.

An object of the present invention is to provide a drier of the type mentioned at the outset which is economical and yet still enables high throughput rates.

SUMMARY OF THE INVENTION

This object may be achieved according to the invention in that e) the inlet lock comprises:

ea) a first air curtain which extends over the entire width of the inlet lock and runs from the bottom up;

eb) a second air curtain behind the first air curtain in the movement direction of the objects, which extends over the entire width of the inlet lock and runs from the top down;

f) the outlet lock is constructed such that it is substantially identical to the inlet lock, but with the objects firstly passing through an air curtain which is directed from the top down and then through an air curtain which is directed from the bottom up.

As a result of the double air curtains which flow in opposite directions and are used according to the invention in the locks, it is possible for the inflow of cold air into the drier chamber and the outflow of hot internal atmosphere into the external atmosphere to be very substantially reduced without having to make recourse to the different densities of cold and hot air and without the objects having to execute vertical movements for this. It is evident that, as a result, the expenditure associated with the locks is considerably reduced by comparison with the expenditure associated with A-locks. It is equally evident that the throughput rate through the drier according to the invention can be increased over that of the prior art as a result of dispensing with the vertical movements.

The nozzle devices generating the air curtains are advantageously adjustable in terms of their directivity and/or throttle effect. It is thus possible to adapt the air curtains both in terms of their geometrical characteristics, for example the divergence, and the flow rate to the objects to be dried or their coatings to be dried.

The nozzle devices generating the air curtains expediently comprise a plurality of slot nozzles or nozzle rows arranged behind one another in the movement direction of the objects. It is thus possible to generate air curtains whereof the extent in the movement direction of the objects is sufficient to generate the desired separation between the external and internal atmospheres.

It is preferred that the air flows forming the air curtains can be guided in a circle with the aid of at least one fan. The air balance within the drier thus remains substantially unaffected by the air curtains.

It is possible to arrange a heating device, in particular a heat exchanger, in the circuit of the air forming the curtains. This enables the air curtains to be brought to a desired temperature which will generally be between the temperature of the external atmosphere and the temperature of the internal atmosphere.

The ratio of the magnitudes of the air flows flowing in the two air curtains is adjustable in an expedient embodiment of the invention. Depending on the type of objects to be dried or coating to be dried, it can be more favourable if the quantity of air flowing in the first air curtain is greater than that in the second air curtain, or vice versa. Simple tests can be used to determine the best option in each case.

The advantages associated with the drier according to the invention become particularly evident in that embodiment in which the conveyor system is the same through the entire drier housing and conveys the objects continuously at a substantially constant height. Therefore, unlike in known driers which operate with A-locks, there is no need to transfer from one conveyor system to the other within the drier. This reduces expenditure on apparatus on the one hand and, on the other, saves on time which would otherwise be associated with transferring the objects from conveyor system to conveyor system.

It is to be understood that the aspects and objects of the present invention described above may be combinable and that other advantages and aspects of the present invention will become apparent upon reading the following description of the drawing and detailed description of the invention.

BRIEF DESCRIPTION OF THE DRAWINGS

An exemplary embodiment of the invention is explained in more detail below with reference to the drawing; the single FIG. 1 shows a schematic view of the entry region of a continuous drier in a vertical section.

DETAILED DESCRIPTION OF THE PRESENT INVENTION

While this invention is susceptible of embodiment in many different forms, there is shown in the drawing and will herein be described in detail one or more embodiments with the understanding that the present disclosure is to be considered as an exemplification of the principles of the invention and is not intended to limit the invention to the embodiments illustrated.

The continuous drier, which is denoted as a whole by the reference numeral 1 and is only shown in the entry region, is intended for drying add-on parts of vehicle bodies which are transported continuously through the continuous drier 1 with the aid of an overhead conveyor (not shown). The type of objects and the type of conveyor system are not important in this regard.

The continuous drier 1 comprises a drier housing 2 which is thermally insulated to prevent heat losses. At its left-hand end in the drawing, the drier housing 2 has an inlet opening 3 through which the add-on parts are firstly introduced into an antechamber 4. From there, they arrive in a lock 7 by way of an opening 5 in an intermediate wall 6 whereof the upper region **6*a*** serves, in a manner described below, as a bulkhead for air guidance.

Along the further movement path, the add-on parts pass through a first air curtain 8, which is directed from the bottom up, and a second air curtain 9 which flows in the opposite direction, i.e. from the top down. From the lock 7, the add-on parts then pass through below a further bulkhead 10 into the actual drier chamber 11. A temperature of up to approximately 250° C. prevails in the drier chamber 11 for the purpose of drying the paint on the add-on parts, as known to the person skilled in the art. The add-on parts now pass through the drier chamber 11; the residence time in this is long enough for the drying procedure to be complete upon their exit from the drier chamber 11. An outlet lock then follows, which corresponds mirror-symmetrically to the inlet lock 7 described above. That is to say the add-on parts pass through below a further bulkhead firstly into an air curtain flowing from the top down and then into an air curtain flowing from the bottom up and finally through below a further bulkhead into an outlet chamber which corresponds to the antechamber 4 mentioned above. The add-on parts then exit the continuous drier 1 by way of an outlet opening, corresponding to the inlet opening 3, and are supplied for further treatment or processing.

The two air curtains 8, 9 (and, accordingly, the two air curtains in the outlet region) are generated in the following manner:

An air channel 12 is constructed below the lock 7 in the drier housing 2 of the continuous drier 1. In the top wall of this air channel 12, there is a nozzle arrangement 13 which is composed of a plurality of slot nozzles or nozzle rows arranged behind one another in the movement direction of the add-on parts. The nozzle arrangement 13 extends over the entire width of the lock 7 and is constructed in known manner such that the direction of the air flowing out, as well as the throttle effect, is adjustable.

A further nozzle device 14 is mounted in the ceiling of the inlet region 7, offset from the nozzle device 13 in the direction of the dryer chamber 11. The nozzle device 14 likewise comprises a plurality of slot nozzles or nozzle rows arranged behind one another in the movement direction of the add-on parts; the exiting air is also adjustable here in terms of its direction and exit velocity.

An outlet opening 15, which can be closed to a greater or lesser extent by a slide valve 16, is located above the first nozzle arrangement 13 in the ceiling of the lock 7. A fan 17, whereof the speed and therefore the delivery rate can be altered, extracts air by way of the opening 15 and an intermediate space 18 and pushes it into an air channel 19 which is arranged above the ceiling of the lock 7. The air then passes through a heat exchanger 20 in which it can be heated to a higher temperature and is then distributed in the following manner: As shown schematically by the arrows in the drawing, a quantity of this air can be discharged into the external atmosphere by way of a throttle valve 21. A further quantity of the air is supplied to the first nozzle device 13 by way of a throttle valve 22. A third quantity of the air finally arrives at the second nozzle device 14 by way of a further throttle valve 23. A slide valve 24 is able to close an opening 25 in a side wall of the intermediate space 18 to a greater or lesser extent and thereby provides a by-pass for the flow of air through the two nozzle devices 13 and 14 if this is required.

The mode of operation of the above-described continuous drier 1 in the inlet region is as follows:

For operation, the first air curtain 8 is established with the aid of the first nozzle device 13 such that it flows upwards with as small an included angle as possible. As this takes place, the bulkhead **6*a* prevents the air curtain 8 exiting to the left in the drawing towards the antechamber 4. With the aid of the nozzle device 13, the central plane of the air curtain 8 can also be set at a slight angle to the vertical. The air forming the first air curtain 8 is extracted via the outlet opening 15 and the intermediate space 18 by the fan 17 and pushed into the air channel 19, heated by the heat exchanger 20 and finally distributed with the aid of the three throttle valves 21, 22, 23. Air is only discharged to the external atmosphere via the first throttle valve 21 by way of exception when this is necessary for the air balance of the continuous drier 1. The distribution of the air to the two nozzle devices 13 and 14 with the aid of the two throttle valves 22, 23 is normally such that the quantity of air in the two air curtains 8, 9** is the same. However, deviations from this are possible if required.

The second nozzle device 14 is likewise set such that the air curtain downwards diverges as little as possible, in particular such that the two air curtains 8, 9 do not overlap to any notable extent. Moreover, with the aid of the second nozzle device 14, the second air curtain 9 is throttled such that it does not reach the floor of the lock 7. Instead, the air turns back in the lower region of the lock 7, as shown by a curved arrow, and now likewise flows upwards, merging in part with the first air curtain 8.

As a result of the two air curtains 8, 9, which are operated in the manner described above, it is possible to achieve a remarkably good separation of the internal atmosphere prevailing in the drier chamber 11 and the environmental atmosphere prevailing outside the drier housing 2. This is the case even though the inlet opening 3 is completely open. The separation relates both to the outflow of hot air from the drier chamber 11 and the inflow of environmental air into the drier chamber 11.

Effective protection against contamination in the drier chamber 11 is thereby ensured at the same time.

The mode of operation of the outlet lock (not illustrated) corresponds substantially to the above-described mode of operation of the inlet lock 7, where it goes without saying that the quantities of air and flow rates of the two air curtains there can be adapted to a certain extent.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A drier for drying objects comprising:

a) a drier housing;

b) a drier chamber which is arranged in the drier housing and in which an internal atmosphere having a higher temperature than an external atmosphere is present;

c) an inlet lock and an outlet lock which reduce the inflow of the external atmosphere into the drier chamber and the outflow of the internal atmosphere into the external atmosphere;

d) a conveyor system which guides objects through the inlet lock, the drier chamber and the outlet lock;

e) wherein the inlet lock comprises ea) a first air curtain which extends over an entire width of the inlet lock and runs from a bottom up;

eb) a second air curtain behind the first air curtain in a movement direction of the objects, and which extends over the entire width of the inlet lock and runs from a top down, wherein air introduced by the second air curtain turns back in a lower region of the inlet lock and flows upwards, at least partly merging with the first air curtain;

f) and wherein, the outlet lock is constructed such that it is substantially identical to the inlet lock, but with the objects first passing through an air curtain which is directed from a top down and then through an air curtain which is directed from a bottom up.

2. A drier according to claim 1, wherein nozzle devices generating the air curtains are adjustable in terms of their directivity and/or throttle effect.

3. A drier according to claim 1, wherein nozzle devices generating the air curtains comprise a plurality of slot nozzles or nozzle rows arranged behind one another in the movement direction of the objects.

4. A drier according to claim 1, wherein air flows forming the air curtains are circulated with the aid of at least one fan.

5. A drier according to claim 4, wherein a heating device is arranged in a circuit of air forming the air curtains.

6. A drier according to claim 1, wherein a ratio of the magnitudes of air flows flowing in the two air curtains is adjustable.

7. A drier according to claim 1, wherein the conveyor system is the same through the entire drier housing and conveys the objects continuously at a substantially constant height.

* * * * *